United States Patent [19]

Helton et al.

[11] Patent Number: 4,875,419

[45] Date of Patent: Oct. 24, 1989

[54] COLLAPSIBLE PAPERBOARD PALLET

[76] Inventors: Catherine Helton; Tim Wright, both of P.O. Box 1407, Pasco, Wash. 99301

[21] Appl. No.: 245,575

[22] Filed: Sep. 19, 1988

[51] Int. Cl.[4] ..... B65D 19/12

[52] U.S. Cl. ..... 108/56.1; 108/51.3

[58] Field of Search ..... 108/51.1, 51.3, 56.1

[56] References Cited

U.S. PATENT DOCUMENTS

| | | | |
|---|---|---|---|
| 2,479,728 | 8/1949 | Darling | 108/51.3 |
| 2,908,464 | 10/1959 | Traudt et al. | 108/56.1 X |
| 2,973,931 | 3/1961 | Brown | 108/56.1 X |
| 3,683,823 | 8/1972 | Schmid | 108/56.1 X |
| 4,039,708 | 8/1977 | Okada | 108/51.3 X |
| 4,185,565 | 1/1980 | Nymoen | 108/56.1 X |
| 4,228,744 | 10/1980 | Moore | 108/56.1 X |

*Primary Examiner*—Peter A. Aschenbrenner
*Attorney, Agent, or Firm*—Keith S. Bergman

[57] ABSTRACT

A pallet is disclosed that is formed completely of paperboard to foldably move from a collapsed to an erected mode. The pallet provides planar upper and lower surfaces with a plurality of tabs defined in each surface to extend inwardly to communicate with similar cooperating tabs from the opposite surface to form pillar-like supports that allow the two surfaces to fold from a collapsed adjacent position to an erected vertically spaced position. End fasteners and side elements communicating between the upper and lower surface elements to aid structural support and rigidity and releasably maintain the erected mode, with the columnar elements substantially in peripendicular relationship to the bottom and top elements. Spaced pairs of channels are defined between the top and bottom elements to allow access of tined forklifts from any side of the pallet. The pallet structure will support traditional loads heretofore supported on wooden pallets of similar size.

9 Claims, 3 Drawing Sheets

COLLAPSIBLE PAPERBOARD PALLET

BACKGROUND OF THE INVENTION

RELATED APPLICATIONS

There are no applications related hereto heretofore filed in this or any foreign country.

1. Field of Invention

Our invention relates generally to pallets for support of merchandise and more particularly to such pallets formed entirely of paperboard to fold from a collapsed to an erected mode.

2. Background and Description of Prior Art

Supportative pallets have long been used for the transport and storage of various merchandise and are today an essential element in such activities. Over the years of their use, pallet structures have become increasingly sophisticated to meet the varying standards and conditions required of them. The instant invention provides a new and novel member of this class of device that was created to provide normal pallet features and in addition to meet modern day requirements of foldability and construction entirely from paperboard that may be totally recycled as such.

In the past, pallets have commonly been formed from rigid material that has had a rigidity somewhat related to the density and mass of material to be supported. For most ordinary merchandise, pallets were commonly formed of wood. Such pallets, however, are relatively heavy, bulky and expensive and with the increased sophistication and progress of the paperboard arts, various portions of such pallet structures have heretofore been formed of paperboard to alleviate some of the wood associated problems. In general, paperboard material is less expensive and yet may fulfill normal and traditional requirements of a wooden pallet.

The instant invention provides a pallet formed completely of paperboard products, in contradistinction to prior art pallets which have in general been formed only partially of such products. This structure provides a distinct advantage because the pallet may be recycled in its entirety in the normal paper processing arts, whereas prior art pallets that had portions formed of material other than pulped paperboard material could not be recycled by repulping without removing the non-paper portions. The instant construction not only allows a complete recycling operation, but also makes the reclamation process simpler and less expensive and in fact, in many instances, allows the single use of a pallet with subsequent recycling of its materials rather than traditional re-use with attendant reshipping costs, potential pallet damage and handling and storage costs.

Pallet structures of the prior art have generally provided a rigid structure formed by rigid elements that are immovable relative to each other. Such structures provide a maximum of difficulty for transport and storage as they occupy the same volume and remain of the same configuration during these processes. These problems associated with rigid pallets previously have been recognized and responsively, various pallets have been devised that may be reduced to a lesser volume for storage or shipment, most commonly by disassembly or sometimes by movably related parts that allow relative motion to form the inoperative storage mode. In general, both the disassemblable and collapsible pallets heretofore known have been formed of rigid dense materials such as wood, and oftentimes with associated more rigid and more dense metal parts, in order to provide the motions required of such devices and yet provide appropriate strength and rigidity to allow them to serve their intended purposes.

Our invention provides a pallet having foldably related parts that allow its manipulation between an erected mode and a collapsed mode having substantially less volume, but in so doing the entire structure is formed entirely of paperboard materials without any non-paperboard components. It is therefore of substantially less weight and generally less cost than the collapsible pallets of the past formed, at least partially, from more dense non-paperboard materials.

The particular structures of our pallet and the method and manner of fastening the pallet in an erected mode are quite essential to its function and operability. Since the upper and lower pallet surfaces and the columns extending between them for support are all formed of paperboard and since this material does not have excessive strength, these parts must be critically configured and positionally related to each other to provide necessary strength for the erected pallet. This is accomplished by particular structure and mechanical connections that allow folding of the various elements and especially by the side fasteners that are sized, configured and notched to require the proper configuration of the pallet to allow its assembly in the erected mode. The particular method and manner of foldably relating the various relatively movable elements is also quite essential as paperboard normally, by reason of its physical constituency, will not generally admit of the use of various separate fastening elements and hinging devices as heretofore used in the more rigid wooden pallet structures of the prior art.

Our invention, while providing the aforesaid features, still allows the normal structures, functions and amenities of present day rigid pallets. The upper and lower pallet surfaces are planar and allow support of rigid or non-rigid merchandise of substantially the same mass and configuration as ordinary wooden pallets of the same areal extent. The pallets may have the same overall thickness and areal dimensions as traditional wooden pallets and defined paired opposed channels extending inwardly from all four sides to allow access and supportive interconnection with ordinary forklifts of commerce from any of those four sides. Our pallet may provide substantially the same strength, rigidity and durability as ordinary wooden pallets of similar configuration, but with substantially less mass and no greater cost than a wooden pallet.

Our pallet additionally allows its upper surface to be folded immediately adjacent its lower surface, which reduces its volume substantially from the volume of the erected mode and makes that reduced volume very near the theoretical minimum. The erected mode may be established by simple manual manipulation by an unskilled person and, when established it is maintained against displacement until further manual manipulation of its side support structure to allow collapse. It is very nearly impossible for the pallet to be accidentally collapsed without appropriate deliberate manual manipulation.

All parts of the pallet that are interconnected are joined by adhesives that allow recycling in the paper pulping process without disruption of that process. The surfaces of the paperboard from which the pallet is formed may be variously treated to provide at least as great smoothness, lack of porosity and impermability as the surfaces of traditional wooden pallets.

In creating our pallet, we provide a structure that fulfills the modern day demands of the pallet arts for an inexpensive durable pallet that is collapsible to a volume substantially less than its erected volume and yet is formed entirely of recyclable paperboard while providing the amenities of other similar present day pallets. In so doing our invention resides not in any one feature per se, but rather in the synergistic combination of all of the structures and features of the device to create the functions necessarily flowing therefrom as hereinafter more fully specified and claimed.

SUMMARY OF INVENTION

Our invention provides a rectilinear supportative pallet, of traditional configuration with planar spaced upper and lower surfaces, formed entirely of paperboard.

A plurality of tabs are defined in the upper and lower pallet surfaces, in a particularly arrayed pattern, so that cooperating tabs from both surfaces may be moved inwardly between those surfaces to come into and be fastened in surface adjacency with each other. These tabs are so arrayed that all of their foldably interconnected edges are parallel, and the sides of the pallet extending in the same direction as the tabs similarly have parallel edges so that the entire structure may fold as a parallelepiped with the upper and lower surfaces substantially adjacent each other. Adjacent tab surfaces are interconnected by adhesion.

End fastening structures, defining plural slots to intercommunicate with adjacent columns, communicate between pallet sides to releasably maintain the erected mode of the pallet with the internal columns arrayed substantially perpendicularly to the horizontal pallet surfaces. In one species of fasteners, the ends of the pallet define tabs that are foldably interconnected tabs for inward extension under the opposite pallet surface to fasten the pallet in its assembled mode. The connectors and pillars are so arrayed that the pallet defines paired spaced forklift tine channels extending between both sides and both ends to accept the tines of ordinary forklifts.

Our pallet is formed in its entirety only from paperboard material and adhesive that may be recycled in normal paper recycling processes without modification of those processes.

In creating such a device, it is:

A principal object of our invention to provide a pallet of substantially the same configuration, rigidity and strength of a traditional wooden pallet and having all of the amenities of the traditional wooden pallet, but one that is formed entirely of paperboard with parts joined where necessary by adhesion.

A further object of our invention to provide such a pallet that is foldably collapsible from an erected mode having the configuration of an ordinary pallet to a collapsed mode with the upper surface substantially adjacent to the lower surface and with a substantially lower volume than that of the erected mode.

A further object of our invention to provide such a pallet that is of substantially less total mass than a traditional wooden pallet of the same size, but which yet possesses substantially the same strength as that similar wooden pallet.

A still further object of our invention to provide such a pallet that is of ordinary pallet size and configuration, defines channels for forklift tines extending from all four vertically edges to allow carriage by an ordinary forklift, and provides other amenities of traditional pallets.

A still further object of our invention to provide such a pallet that is of new and novel design, of rugged and durable nature, of simple and economic manufacture and one otherwise well suited to the uses and purpose for which it is intended.

Other and further objects of our invention will appear from the following specification and accompanying drawings which form a part hereof. In carrying out the objects of our invention, however, it is to be understood that its essential features are susceptible of change in design and structural arrangement with only one preferred and practical embodiment being illustrated in the accompanying drawings, as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
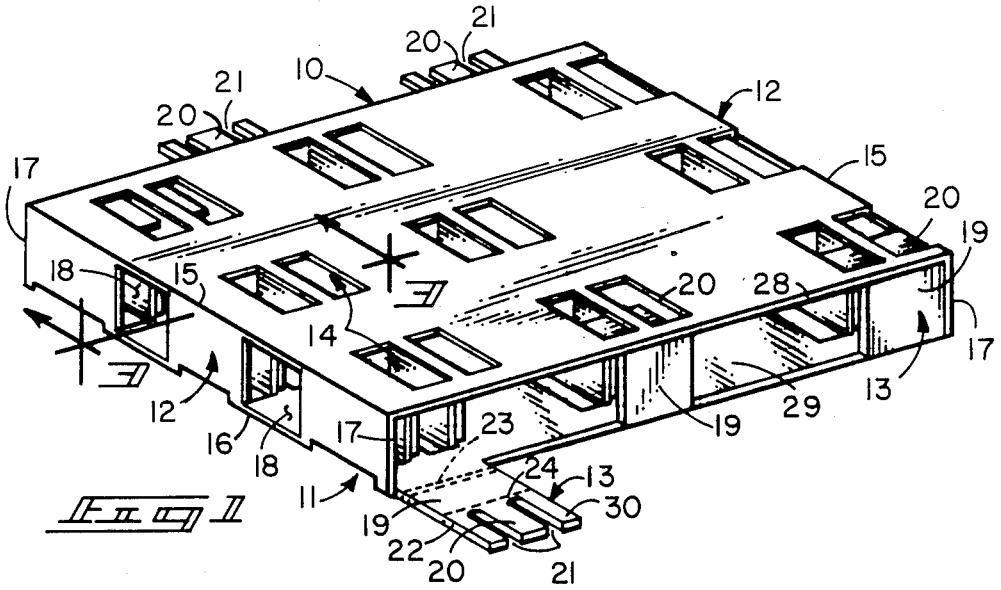
FIG. 1 is an isometric surface view of our pallet showing its various parts, their configuration and relationship.
Figure 3:
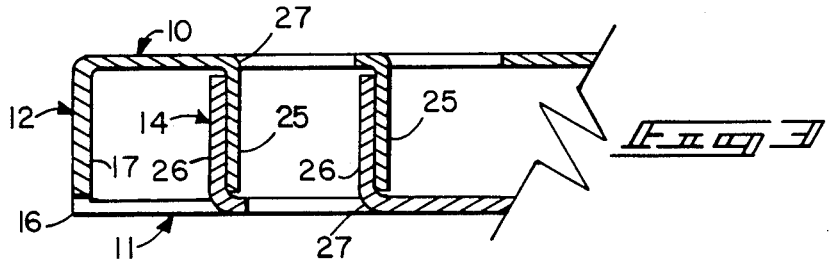
FIG. 3 is a partial vertical cross-sectional view through the pallet of FIG. 1, taken on the line 3—3 thereon in the direction indicated by the arrows.

Our invention generally provides a foldable pallet with planar parallel top 10 and bottom 11 interconnected by similar sides 12 and having similar ends 13 with pillars 14 extending between the top and bottom members.

Top 10 and bottom 11 are planar elements of similar peripheral configuration and size. In their interrelated position in our pallet structure, one is the mirror image of the other, as illustrated particularly in FIGS. 1 and 2 of the drawings. The top and bottom elements may be of any reasonable size and configuration, but commonly for convenience in the modern day transportation and storage arts, they will be of the standardize sizes of traditional pallets heretofore used for merchandise support. This dimensioning has been reasonably standardized in square modules having a side dimension of four feet. Sometimes smaller pallets forming a part of such module are used in commerce, such as elongate pallets having a dimension of two by four feet. Pallets having an areal extent greater than four by four square feet are known and used, but not so commonly as their smaller counterparts.

Sides 12 communicate between and foldably interconnect top 10 and bottom 11. The two sides 12 are similar to each other in dimension and configuration and each has upper side edge 15 and lower side edge 16 of the same length as that of the adjoining edges of the top and bottom elements intercommunicating therewith. The height of the sides, along vertical edges 17, defines the thickness of the pallet, which again by a custom in the transportation and storage arts is commonly four inches, though obviously this dimension may vary somewhat and yet remain within the ambit and scope of the instant invention.

Each side defines two spaced forklift orifices 18 to allow the insertion of the two spaced tines of a traditional lift structure of a commercial forklift therethrough. Commonly forklift tine sizes and their positioning are reasonably standardized so that two slots having a horizontal dimension of six inches and a vertical dimension of three inches with a distance between the outermost edge of each orifice of thirty-six inches will accommodate most tine structures of the common forklifts of present day commerce. Though not necessary for insertion of forklift tines, it is desirable that orifices 18 be defined between the inner adjacent surfaces of the top and bottom members so that when the pallet is picked up by a forklift, the upper surface of the forklift tines may rest immediately below the lower surface of the top or bottom member to provide greater rigidity and support for the pallet and its load than were this not the case.

Commonly, the top, bottom and side members will be unitarily formed with all intercommunicating edges 15, 16 being parallel to each other so that the pallet structure may be folded between an erected rectilinear mode and a collapsed parallelogram mode with the inner adjacent surfaces of the top and bottom substantially adjacent to each other. The intercommunicating portions of these pallet elements have folds defined in the material from which they are formed, according to principles heretofore known in the paperboard arts, to allow such foldable motion of the elements.

In the species of pallet illustrated in FIGS. 1–6, ends 13 provide fasteners in the form of plural tab structures, each having vertical end portion 19 foldably interconnecting fastening portion 20. The tab structures 19, 20 are defined as a foldably interconnected, laterally extending portion of ends of both the top and bottom members. Preferably the tabs are formed on one end of the top element and the opposite end of the bottom element which preserves the mirror similarity of the top and bottom elements and tends to provide better ultimate fastening and support in the assembled pallet. The number and positioning of the end tabs is dependent upon the ultimate dimensioning and construction of the pallet itself and, though in the instance illustrated, these tabs are three in number, that number may vary within limits. There should be an end tab at both sides of the pallet and normally at least one medial tab. Commonly, pillar structures will be associated in linear array and preferably there is one end tab at each end of each line of piller structures to aid maintenance of the proper assembled positioning of the pallet.

Each foldable fastening portion 20 defines one or more pillar slots 21 extending from the outer edge of that tab inwardly a spaced distance to fit about adjacent pillars defined within the pallet structure to maintain perpendicular alignment of those pillars. The tab structures adjacent each side are preferably so configured that their side facing edges 22 fit immediately inwardly adjacent the inner surface of sides 12 when the pallet is in its erected mode to aid in maintaining the perpendicular positioning of the sides relative to the top and bottom elements in that mode.

To aid assemblage of the end tabs within our erected mode of our pallet, the outwardly extending dimension of foldable fastening portion 20 will not be greater than the similar dimension of vertical end element 19, and preferably slightly less, to allow proper and easy assemblage of the pallet as hereinafter more fully described. The foldable interconnection of each end tab with its supporting bottom or top element is agein defined substantially at, and parallel to, the end line of top and bottom elements 10 and 11 and the outer fold line 24 between end portions 19 and fastening portions 20 is similarly parallel thereto.

Figure 7:
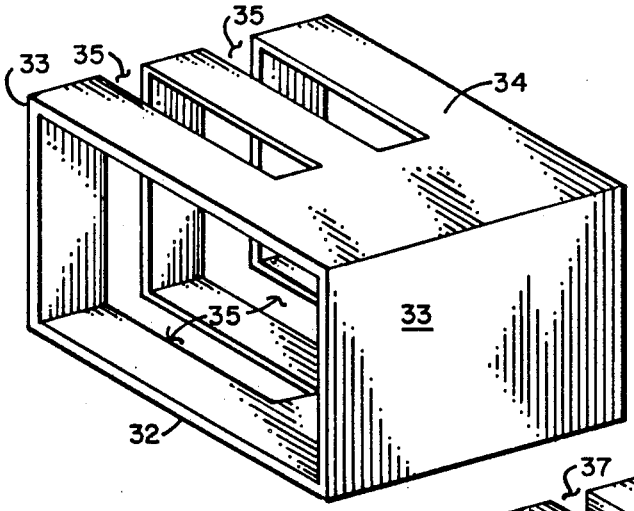
FIG. 7 shows a species of end connector formed as a separable tube.
Figure 8:
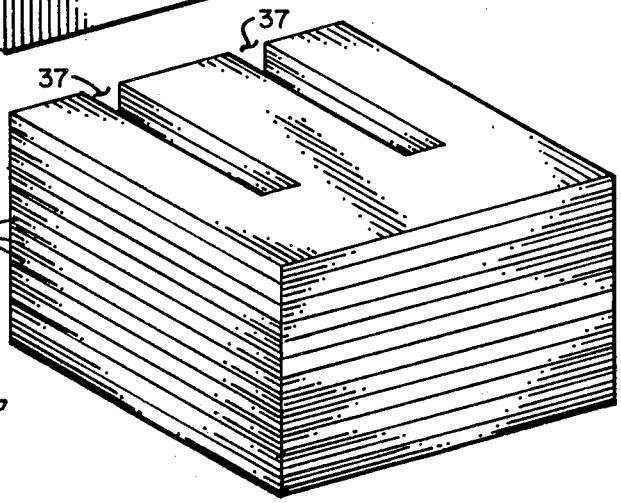
FIG. 8 shows a species of end connector formed as a separable solid block.
Figure 9:
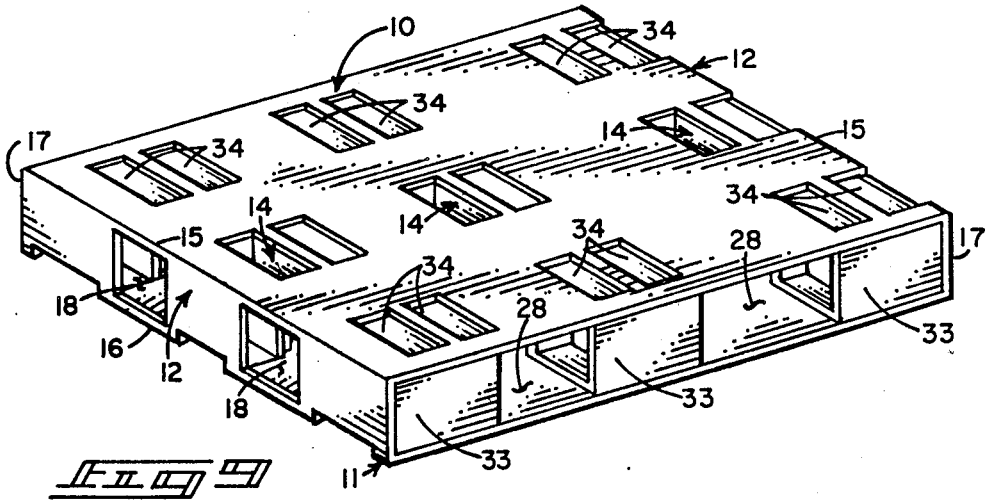
FIG. 9 is a partially cutaway isometric view of a pallet using the device of FIG. 7 as end connectors.

Two species of end fasteners that are not interconnected to the pallet structure are shown in the illustrations of FIGS. 7–9. The structure of FIG. 7 provides a tubular element peripherally defined by bottom 32, similar side 33 and top 34, all formed of paperboard and structurally interconnected, preferably in a foldable fashion for collapsibility during non-use. Similar paired cooperating slots 35 are defined in the top and bottom, extending inwardly from the end edges, to receive adjacent pillar structures in a frictional fit to cause fastening of a pallet in a fashion similar to the end tabs previously described. The vertical height of the fastening tube should be such as to fit immediately inwardly adjacent the inner surfaces of pallet top and bottom elements when the pallet be in an erected mode, to provide additional strength and rigidity.

The species of fastener illustrated in FIG. 8 is similar to that of FIG. 7 in peripheral shape, but it is solidly formed of a plurality of stacked sheets 36 of paperboard having their adjacent surfaces adhered to each other. This fastener defines slots 37 arrayed similarly to the slots of the tubular species of fastener, but defined vertically through the entire solid fastener structure. It is used in the same fashion as the tubular species of fastener.

Pillars 14 support the interior portions of pallet top 10 and bottom 11 in spaced parallel adjacency. These pillars are formed of similar paired opposed tab elements, the tab 25 of one pair being defined in and carried by top member 10 and the other tab 26 of that pair being defined in and carried by bottom member 11. Each tab in the form illustrated constitutes a rectinlinear element cut from its forming element about three edges and folded at its fourth edge to extend inwardly to meet its paired counterpart in surface adjacency. Tab folds 27 are defined by traditional methods of the paperboard arts to provide a lineal fold that interconnects the tab with the structure from which it was formed, but yet allows pivotal motion of the tab relative thereto.

Figure 2:
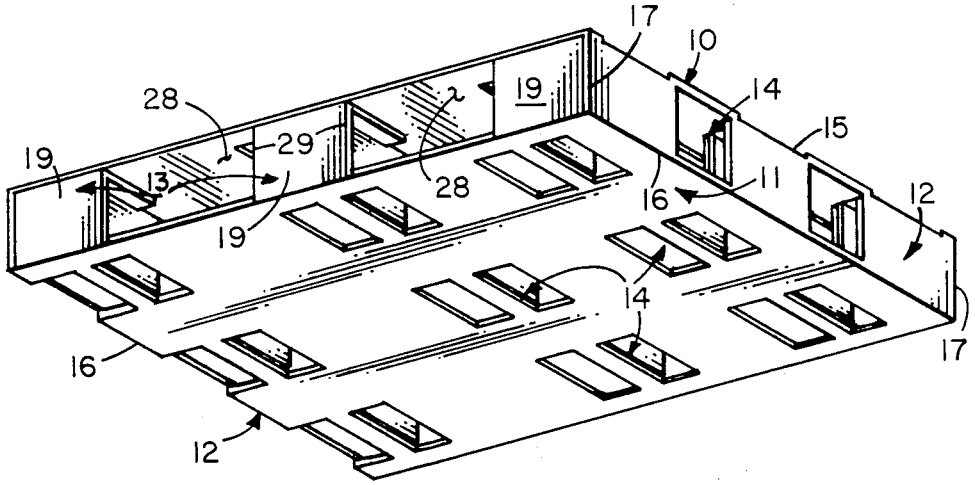
FIG. 2 is an isometric view of the bottom of the pallet illustrated in FIG. 1, showing its various features from this aspect.
Figure 4:
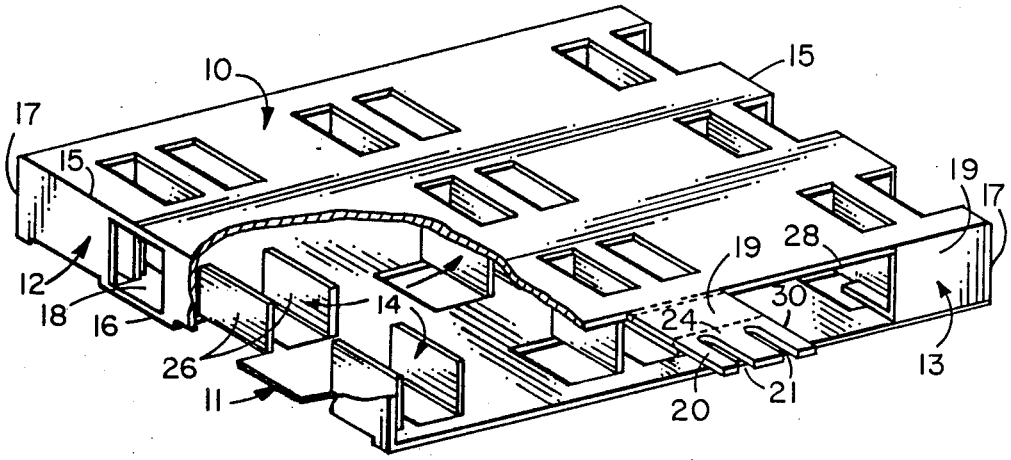
FIG. 4 is a partially cut-away isometric view of the pallet of FIG. 1, showing its internal structure.

The positioning, sizing and configuration of pillar tabs is material to our invention. In general, a plurality of pillar tabs are provided in somewhat evenly spaced array over the surfaces of both top and bottom elements to provide appropriate support between those elements to allow the tabs to fulfill their intended purposes. This type of array is most conveniently accomplished, as illustrated, by forming the pillar tabs so that they create perpendicularly related rows and columns, the rows parallel to the side edges and the columns perpendicular to those edges. Preferably the pillars are associated in paired sets with more space about then between sets and again, both rows and columns will preferably be defined closely inwardly adjacent each of the sides and ends of a pallet structure. The array of tab pillars must be such as not to lace them in forklift tine channels 28 so as to obstruct those channels and this, with ordinary sized four foot by four foot pallets, is quite conveniently accomplished by an array of nine sets of paired pillars, as illustrated in FIG. 1. Obviously other dimensioning and spacing of pillar elements may accomplish the purposes of our invention and would be within its ambit and scope.

The dimension of vertical ends 29 of each pillar tab is substantially the same as the distance between top and bottom members, that is, the vertical distance between their adjacent facing surfaces. The length of longer side 30 of each tab is somewhat greater than the end dimension to allow the tab to extend from the edge of one tine channel to that of the adjacent channel or from the edge of a tine channel to a spaced distance from the end of the pallet, as the case may be, in the latter instance to leave a margin 31 between the tabs and the pallet ends to aid pallet support in the erected mode.

Figure 5:
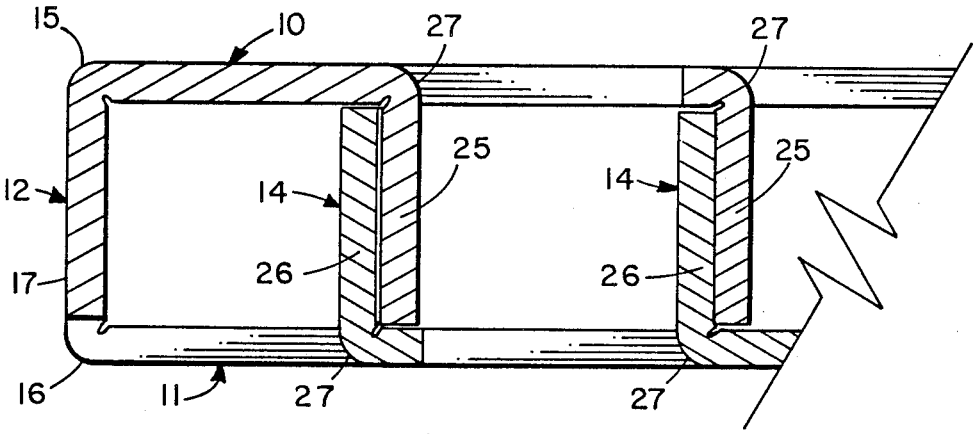
FIG. 5 is an enlarged, partial vertical cross-sectional view through the side and first row of columns of the pallet of FIG. 4, taken on the line 5—5 thereon in the direction indicated by the arrows, to show the relationship of elements when in an erected mode.
Figure 6:
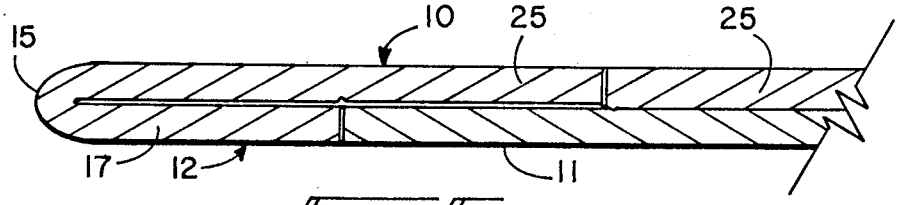
FIG. 6 is a view of the same cross-section as FIG. 5, except that the pallet has been completely folded to its collapsed mode.

The positioning of pillar forming tabs 25 in top member 10 must also be related to the positioning of tabs 26 in bottom member 11 so that the cooperating tabs in each pillar set fold into surface adjacency and move back into the orifices from which they were created when the pallet structure is folded to its collapsed mode. This arrangement of tabs in a pillar set is best shown in the illustration of FIG. 5. Here top tab **25*a* is defined with its edge, on the inner surface of the top element, positioned vertically above the fold of the inner surface defining bottom tab 26*a*, with each tab being formed on opposite sides of these folds so that the two opposed tabs of a set will fold with their facing surfaces in immediate adjacency, as illustrated. It is also necessary in defining the position of pillar tab elements that all foldably connected edges of those elements be parallel to each other and also parallel to top side edge 15 and bottom side edge 16** for our pallet to allow the foldable action required of the structure.

In the completed pallet, the adjacent surfaces of each of a tab pair forming a pillar 14 are mechanically interconnected by adhesive 32. This adhesive is one heretofore known in the paper forming arts that can be removed or chemically modified in a recycling process so as not to harm or disrupt that process. Various such adhesives have heretofore become known and are usable in our pallet. The only requirements of this adhesive are that it mechanically join the adjacent tab elements and not disrupt future recycling operations.

Our entire pallet structure is formed of paperboard, commonly of the so-called corrugated fiberboard variety. The sophistication of such material has developed during its historicity until in the modern day such material is quite dense, strong and rigid, in general possessing those charactristics to at least the same degree as wood of the same size and similar configuration. Preferably a multi-ply corrugated fiberboard having sets of ply elements extending perpendicularly to each other, to orient major directions of strength perpendicular to each other, are used to form the elements of our invention. Such material is commonly created in sheet form and is available in present day commerce.

If desired or required, various specialized materials having multiple plies with varying orientations may be used for the our pallet. Such material, however, cannot be too thick, or at least must be formable with hinge-type folds, in order for the material to fulfill the purposes of our invention. Commonly, the folds in the material will be established by known methods that press and compact the material along a fold line to make that line more flexible and resiliently deformable than the material on either side of the fold. such folding processes are known in the paperboard forming arts, as is the mechanism to accomplish them.

Having thusly described the structure of our invention, its operation may be understood, especially with reference to the appended drawings.

A pallet is formed as specified and illustrated. This pallet when obtained for use normally will be in a collapsed mode with the structure forming a parallelepiped with the top member substantially adjacent the bottom member.

To erect the pallet of FIGS. 1–6, the structure is manually moved so that sides 12 and pillars 14 are substantially perpendicular to the top and bottom elements. While manually maintaining the structure in this position, end tabs 19 and 20 are sequentially partially folded and the outer fastening tab portions inserted inwardly adjacent the inwardly facing surface of the pallet top or bottom member opposite that to which the tab is attached. The tabs are then moved inwardly so that the adjacent pillars fit within pillar slots 21 which, when moved inwardly to their fullest extent, will position portion 19 of the end element in a vertical orientation. The pallet structure is then fastened in its erected mode.

It is to be noted that in the erected mode, the end tabs will have one lateral edge immediately inwardly adjacent the inner surface of the adjacent side and will extend between that side and the inwardly adjacent pillar, all to positionally maintain the pallet structure in its erected mode and add to its rigidity.

Pallets using the species of separate fasteners of FIGS. 7–9 are assembled in substantially the same fashion as heretofore described. When the pallet is manually positioned in its erected mode, one fastener is inserted and this will maintain the pallet configuration until the other fasteners may be inserted. Once inserted, the fasteners will be positionally maintained by frictional forces resulting from their engagement with the pallet structure.

The erected pallet may be disassembled, when desired, to its collapsed mode merely by manually removing the fastening elements and folding the pallet structure to its collapsed state with the top element immediately adjacent the bottom element. It is to be noted that if the structure be folded in one direction, the pillar tabs forming individual pillars will rest in the slots from which they were defined, so that in such position, the top and bottom element will be in immediate surface adjacency. If the pallet be folded in the opposite direction, the adjacent surfaces of top and bottom elements will be spaced from each other at least by the thickness of the pillar elements. In either collapsed mode, however, the volume occupied by the pallet is substantially less than that occupied in its erected mode, though that volume will differ depending upon the degree and nature of folding.

It should be particularly noted that though our invention is especially adapted for use with paperboard-type products, it may use other similar material, such as polymeric or resinous plastic that has some general rigidity and foldability and even with non-foldable materials by using hinges at fold lines and making appropriate adjustment in the sizing and configuration of elements. The pallet, when formed of ordinary five ply paperboard of present day commerce, to a forty-eight by forty-eight inch peripheral configuration with an erected thickness of approximately four inches, has substantially the same strength as a similar pallet formed by traditional methods from wood, though the paolet of our invention has substantially less mass, less cost and less volume in its collapsed mode.

The foregoing description of our invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described our invention, what we desire to protect by Letters Patent and what we claim is:

1. A foldably collapsible pallet comprising, in combination:

planar horizontal top and bottom members foldably joined at adjacent opposed side edges by side elements, all said foldably joined edges being linear and parallel;

a plurality of similar pillar tabs defined in the top and bottom members, each pillar tab having one edge foldably interconnected to the element defining it, with all said foldable edges being parallel to the foldably joined edges of the top and bottom members, said tabs arrayed in paired opposed sets in the top and bottom members so that one pillar tab, when extended inwardly, fits in surface adjacency with the other pillar tab of its set when extended inwardly, each pillar tab set being mechanically interconnected with its tabs in surface adjacency and each pillar set being parallel to all other pillar sets; and fastening means for releasably maintaining the pallet in an erected rectilinear mode.

2. The invention of claim 1 wherein the fastening means comprise at least one fastening tab foldably carried by the end edge of a planar horizontal member and having an outer end portion defining inwardly extending pillar slots to receive portions of adjacent pillars, said outer end portion being foldable inwardly to fasten the pallet in its erected mode.

3. The invention of claim 1 wherein the fastening means comprises a peripherally defined tubular element, having a vertical height equal to the vertical distance between the adjacent surfaces of the top and bottom planar members when in the erected mode, defining at least one pillar slot to releasably receive a portion of an inwardly adjacent pillar therein.

4. The invention of claim 1 wherein the releasable fastener comprises a block formed of a plurality of stacked, mechanically joined paperboard elements, said block having a vertical height equal to the vertical distance between the adjacent surfaces of the top and bottom members when in the erected mode and defining at least one pillar slot to releasably receive a portion of an inwardly adjacent pillar therein.

5. The structure of claim 1 wherein the pallet are formed of repulpable paperboard.

6. The invention of claim 1 further characterized by:

sets of pillar tabs and end fasteners being arrayed to define paired opposed lift truck tine channels extending inwardly from each side and each end of the pallet and vertically between the adjacent surfaces of top and bottom members.

7. The invention of claim 1 further characterized by:

the pillar tabs defined in paired sets in three rows and three columns to define tine channels between adjacent sets of rows and adjacent sets of columns, and the fastening means carried at each end of the pallet between forklift tine channels.

8. A foldably collapsible pallet comprising in combination:

similar planar top and bottom horizontal members joined at each set of side edges by rectilinear side elements, all said foldably joined edges being linear and parallel;

a plurality of similar rectilinear pillar tabs defined in cooperating sets, one member of each set defined in each horizontal member and foldably interconnected with the member defining it, said foldable interconnections being parallel to the foldably joined edges of the sides and horizontal members, and said sets of pillar being arrayed to fold inwardly into adjacently with and being fastened to the other member of its set;

plural spaced fastening tabs foldably carried by the end edge of one horizontal members at each pallet end, each said fastening tab having a medial portion and a foldably interconnected fastening portion defining plural pillar slots to fold inwardly to receive portions of adjacent pillars in said fastening slots.

9. The invention of claim 6 further characterized by the pillar tabs and fastening tabs arrayed to define to spaced lift truck tine channels extending inwardly from each vertical side and end of the pallet.

* * * * *

UNITED STATES PATENT AND TRADEMARK OFFICE

CERTIFICATE OF CORRECTION

PATENT NO. : 4,875,419

DATED : October 24, 1989

INVENTOR(S) : CATHERINE HELTEN and TIM WRIGHT

It is certified that error appears in the above—identified patent and that said Letters Patent is hereby corrected as shown below:

Abstract Page, Item (76)

Inventors: Catherine Helten; Tim Wright, both of P. O. Box 1407, Pasco, Washington 99301

Item [19] "Helton, et al" should read --Helten, et al.

Signed and Sealed this

Sixth Day of November, 1990

*Attest:*

HARRY F. MANBECK, JR.

*Attesting Officer*

*Commissioner of Patents and Trademarks*